US007798585B2

(12) United States Patent
Oguri

(10) Patent No.: US 7,798,585 B2
(45) Date of Patent: Sep. 21, 2010

(54) INK DETECTING DEVICE, IMAGE RECORDING APPARATUS, INK DETECTING METHOD AND PROGRAM RECORDING MEDIUM

(75) Inventor: Atsushi Oguri, Yokohama (JP)

(73) Assignee: Olympus Corporation, Tokyo (JP)

( * ) Notice: Subject to any disclaimer, the term of this patent is extended or adjusted under 35 U.S.C. 154(b) by 898 days.

(21) Appl. No.: 11/634,465

(22) Filed: Dec. 5, 2006

(65) Prior Publication Data

US 2007/0165053 A1 Jul. 19, 2007

(30) Foreign Application Priority Data

Dec. 8, 2005 (JP) ..... 2005-354325

(51) Int. Cl.
*B41J 2/195* (2006.01)
*B41J 2/175* (2006.01)

(52) U.S. Cl. ..... 347/7; 347/86

(58) Field of Classification Search ..... 347/7, 347/86

See application file for complete search history.

(56) References Cited

U.S. PATENT DOCUMENTS 4,551,734 A 11/1985 Causley et al.
4,568,954 A 2/1986 Rosback
2002/0008724 A1 * 1/2002 Kubota et al. ..... 347/19
2006/0188646 A1 * 8/2006 Yun et al. ..... 427/8

FOREIGN PATENT DOCUMENTS

JP 3-55313 B2 8/1991
JP 10-175312 A 6/1998

* cited by examiner

*Primary Examiner*—Matthew Luu
*Assistant Examiner*—Jannelle M Lebron
(74) *Attorney, Agent, or Firm*—Frishauf, Holtz, Goodman & Chick, P.C.

(57) ABSTRACT

A transmission/reception element transmits an ultrasound wave to an ink liquid contained in an ink tank. At this time, a near sound field of the ultrasound wave is formed within a propagating member when it propagates the ultrasound wave transmitted from the transmission/reception element to the ink liquid. The transmission/reception element receives the ultrasound wave that is transmitted, reflected on the surface of the ink liquid, and comes back. An ink remaining amount calculating unit calculates the remaining amount of the ink liquid based on an elapsed time required from the transmission until the reception.

11 Claims, 12 Drawing Sheets

INK DETECTING DEVICE, IMAGE RECORDING APPARATUS, INK DETECTING METHOD AND PROGRAM RECORDING MEDIUM

CROSS REFERENCE TO RELATED APPLICATIONS

This application claims benefit of Japanese Application No. 2005-354325 filed Dec. 8, 2005, the contents of which are incorporated by this reference.

BACKGROUND OF THE INVENTION

1. Field of the Invention

The present invention relates to a technique for detecting ink within a tank for containing the ink.

2. Description of the Related Art

Image recording apparatus include a copier, a printer, a facsimile, etc. In the copier, a reading mechanism, such as an image reading apparatus, etc., for reading a manuscript is provided, and image recording is made by imaging and fusing the manuscript read by the reading mechanism on printing paper. The printer makes image recording by imaging and fusing pictorial data transmitted from a computer, etc. on printing paper. Additionally, the facsimile makes image recording by imaging and fusing pictorial data transmitted via a telephone line, etc. on printing paper.

A printer, which comprises an inkjet head, forms and records a graphic, a character, etc. on a recording medium by spraying ink droplets onto paper or other recording medium, has been attracting attention in recent years. Since this printer normally uses a replaceable ink tank of a sealed type, an ink remaining amount detecting sensor must be provided to detect and display the remaining amount of ink within the ink tank.

As a conventional ink remaining amount detecting sensor, for example, a sensor disclosed by Japanese Published Examined Patent Application No. H3-55313 is known. In this sensor, two electrodes made of stainless steel, which are arranged to be soaked in ink within an ink tank, are provided, and the resistance value of the ink between the electrodes is monitored by applying a voltage in between the electrodes, thereby detecting the remaining amount of the ink within the tank.

Additionally, for example, also Japanese Published Unexamined Patent Application No. H10-175312 discloses a technique for measuring the remaining amount of ink. An ink remaining amount detecting device according to this technique comprises a detecting unit, a measuring unit, and a controlling unit. Here, the detecting unit detects an ultrasound wave, which is propagated with a transmission/reception element arranged on the bottom of an ink tank or with a transmission/reception element arranged vertically lower than a surface on which an ink supply hole exists, is reflected on the surface of an ink liquid and comes back to the transmission/reception element. The measuring unit measures, via the controlling unit, a time required from when the ultrasound wave is transmitted from the transmission/reception element until when the ultrasound wave is reflected on the surface of the ink liquid and comes back to the transmission/reception element. The controlling unit detects the value of the liquid surface level of the ink within the ink tank from the required time measured by the measuring unit. This device measures the remaining amount of ink in this way.

However, with the technique, which is disclosed by the above described Japanese Published Examined Patent Application No. H3-55313, for causing ink to contact electrodes in order to detect the remaining amount of the ink, an electric current is made to flow into the ink via the electrodes, and accordingly, the components of the ink is electrolyzed, and the quality of the ink alters.

Additionally, the device disclosed by the above described Japanese Published Unexamined Patent Application No. H10-175312 has a problem that the phenomenon of a near sound field is not considered. This problem is described.

FIG. 1 shows the state of propagation of an ultrasound wave generated by a piezoelectric element. This figure shows the state where the ultrasound wave propagates from the piezoelectric element 111 accommodated within an ultrasound wave transmission mechanism 112 to a medium 113. Here, a white portion within the medium 113 indicates a portion where a sound pressure is high, whereas a black portion indicates a portion where the sound pressure is low.

As shown in this figure, in a far sound field 115, which is a portion far from the piezoelectric element 111 within the medium 113, the pattern of the white portion is stable, and exhibits acute linearity. In the meantime, in a near sound field 114 in the neighborhood of the piezoelectric element 111, the white portion has a fine pattern, which indicates a complicated change in the sound pressure. The near sound field 114 is generated by interference between ultrasound waves emitted from the central portion of the piezoelectric element 111 and from its end among ultrasound waves emitted from the piezoelectric element 111. This phenomenon is also called a near interference zone (Fresnel zone), etc.

With the technique disclosed by the above described Japanese Published Unexamined Patent Application No. H10-175312, the characteristic of an ultrasound wave in such a near sound field is not considered. Therefore, a wave reflected on the surface of an ink liquid cannot be identified due to the influence of the characteristic, and the remaining amount of ink cannot be properly obtained in some cases.

SUMMARY OF THE INVENTION

A device in one aspect of the present invention is an ink detecting device for detecting ink contained in a tank, and comprises a transmission/reception element for transmitting/receiving an ultrasound wave, a sound absorbing member for absorbing at least the ultrasound wave from the transmission/reception element, a propagating member, which is interposed between the transmission/reception element and propagates the ultrasound wave transmitted from the transmission/reception element to the ink, and in which a near sound field of the ultrasound wave transmitted from the transmission/reception element is formed, and an ink remaining amount calculating unit for calculating the remaining amount of ink based on an elapsed time required from when the transmission/reception element transmits the ultrasound wave until when the transmission/reception element receives the ultrasound wave reflected on the liquid surface of the ink.

A apparatus in another aspect of the present invention is an image recording apparatus for detecting ink contained in a tank, and comprises a transmission/reception element for transmitting/receiving an ultrasound wave, a sound absorbing member for absorbing at least the ultrasound wave from the transmission/reception element, a propagating member which propagates the ultrasound wave transmitted from the transmission/reception element to the ink and in which a near sound field of the ultrasound wave transmitted from the transmission/reception element is formed, an ink remaining amount calculating unit for calculating the remaining amount of the ink based on an elapsed time required from when the transmission/reception element transmits an ultrasound wave until when the transmission/reception element receives the ultrasound wave reflected on the liquid surface of the ink, and an ink head for recording an image on an image recording medium by spraying ink.

A method in a further aspect of the present invention is an ink detecting method for detecting ink contained in a tank, and comprises transmitting an ultrasound wave to ink, forming a near sound field of the ultrasound wave within a propagating member for propagating the transmitted ultrasound wave to the ink, receiving the ultrasound wave which is transmitted, reflected on the liquid surface of the ink and comes back, measuring an elapsed time from the transmission to the reception, and calculating the remaining amount of the ink based on the elapsed time.

A program recording medium in a still further aspect of the present invention is a program recording medium on which is recorded a program for causing an arithmetic processing unit to detect ink contained in a tank, and from which the program can be read, the program causing the arithmetic processing unit to execute: a process for causing a transmission/reception element for transmitting/receiving an ultrasound wave to transmit the ultrasound wave, and for forming a near sound field of the ultrasound wave within a propagating member for propagating the ultrasound wave from the transmission/reception element to the ink; a process for causing the transmission/reception element to receive the ultrasound wave that is transmitted, reflected on the liquid surface of the ink, and comes back; a process for measuring an elapsed time from the transmission to the reception; and a process for calculating the remaining amount of the ink based on the elapsed time.

A program recording medium in a still further aspect of the present invention is a program recording medium on which is recorded a program for causing an arithmetic processing unit to detect ink contained in a tank, and from which the program can be read, the program causing the arithmetic processing unit to execute: a process for causing a transmission/reception element for transmitting/receiving an ultrasound wave to transmit the ultrasound wave, and for forming a near sound field of the ultrasound wave within a propagating member for propagating the ultrasound wave from the transmission/reception element to the ink; a process for causing the transmission/reception element to receive the ultrasound wave that is transmitted, reflected on a reflection mechanism supported in a state of being soaked in the ink within the tank, and comes back; a process for measuring an elapsed time from the transmission to the reception; and a process for determining the type of the ink based on the elapsed time.

BRIEF DESCRIPTION OF THE DRAWINGS

The present invention will be more apparent from the following detailed description when the accompanying drawings are referenced.

DESCRIPTION OF THE PREFERRED EMBODIMENTS

Preferred embodiments according to the present invention are hereinafter described with reference to the drawings.

First Preferred Embodiment

Figure 1:
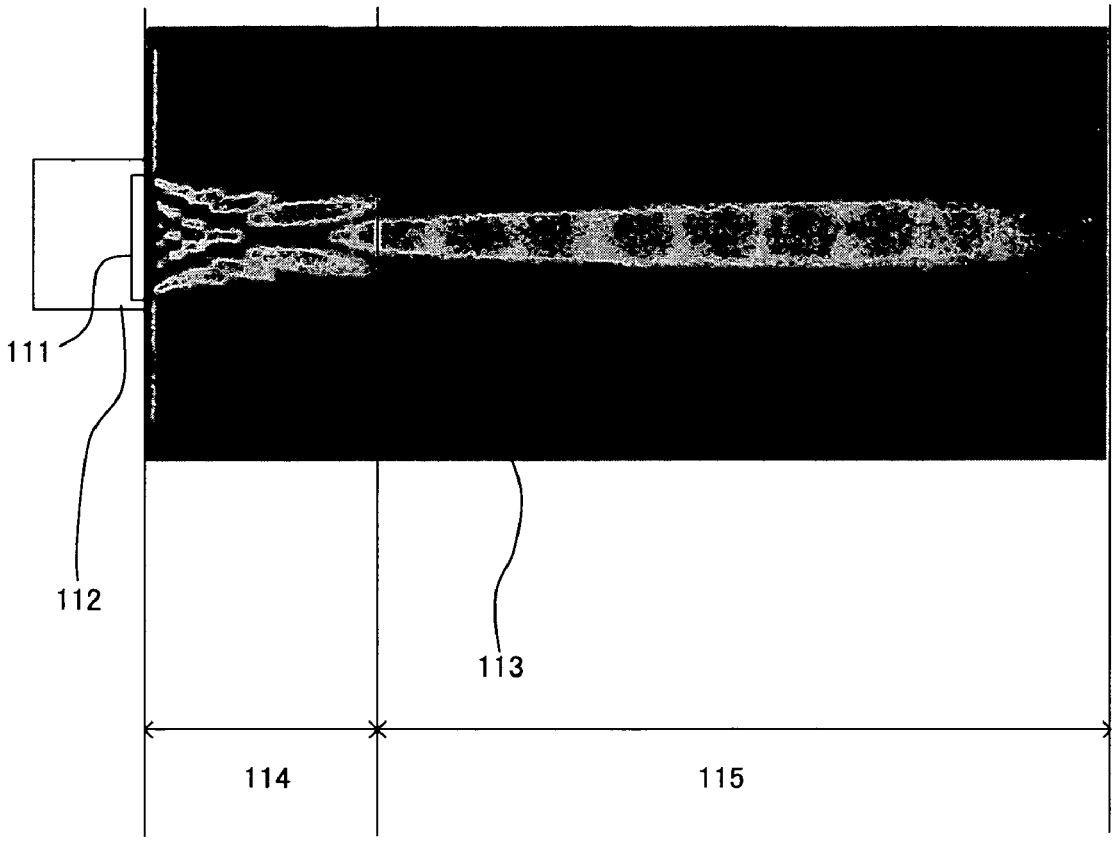
F I G. 1 PRIOR ART
FIG. 1 shows the state of propagation of an ultrasound wave generated by a piezoelectric element.
Figure 2:
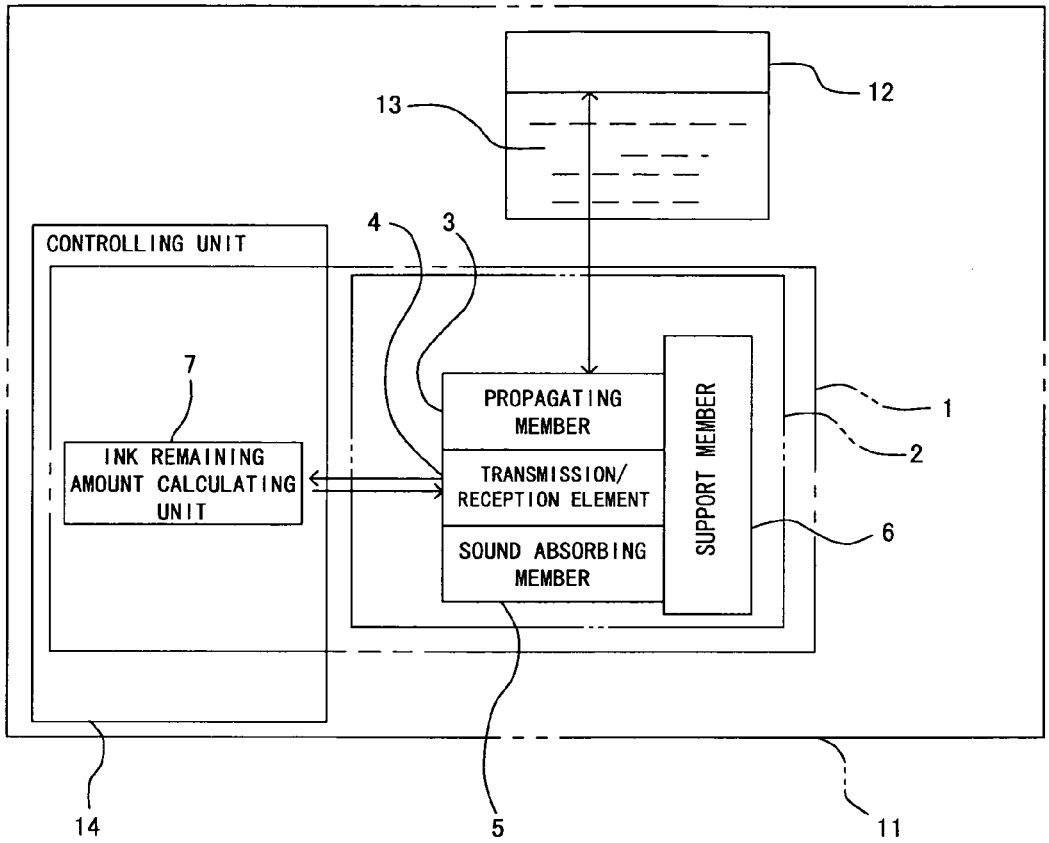
FIG. 2 is a conceptual block diagram showing an image recording apparatus comprising an ink detecting device according to a first preferred embodiment.

FIG. 2 is first described. This figure is a conceptual block diagram showing an image recording apparatus 11 comprising an ink detecting device 1 according to this preferred embodiment. Note that the image recording apparatus 11 may be any of apparatus, such as a printer, a facsimile, a copier, etc., for recording an image on a recording material based on image data.

In FIG. 2, the ink detecting device 1 comprised by the image recording apparatus 11 is intended to detect the remaining mount of an ink liquid 13 contained in an ink tank 12, and configured by comprising an ink liquid surface detecting sensor 2 and an ink remaining amount calculating unit 7.

The ink liquid surface detecting sensor 2 is a sensor for detecting a reflection wave of an ultrasound wave emitted by the ink liquid surface detecting sensor 2 itself by transmitting/receiving the ultrasound wave. The ink liquid surface detecting sensor 2 is configured by comprising a propagating member 3, a transmission/reception element 4, and a sound absorbing member 5, which are supported by a support member 6.

The propagating member 3 is a member interposed between the transmission/reception element 4 and the ink liquid 13. The propagating member 3 propagates the ultrasound wave transmitted from the transmission/reception element 4 to the ink liquid 13, and propagates the ultrasound wave, which reflects on the surface of the ink liquid 13 and comes back, to the transmission/reception element 4.

The transmission/reception element 4 is, for example, a piezoelectric vibrator, and transmits/receives the ultrasound wave under a control performed by a controlling unit 14.

The sound absorbing member 5 is a member for absorbing the ultrasound wave, which is considered to possibly exert an influence (interference, etc.) on the detection of the height of the surface of the ink liquid, among the ultrasound waves emitted from the transmission/reception element 4.

The controlling unit 14 is intended to control various types of operations of the entire image recording apparatus 11, and also functions as an ink remaining amount calculating unit 7 for calculating the height of the surface of the ink liquid 13 based on a control for the transmission/reception element 4 and a result of the control. Note that the ink remaining amount calculating unit 7 may be implemented by causing a CPU comprised by the controlling unit 14 to execute a program stored in the controlling unit 14. Or, this program may be stored in an arithmetic processing unit other than that of the controlling unit 14.

The ink remaining amount calculating unit 7 calculates the height of the surface of the ink liquid 13 based on a time required from when an instruction to transmit the ultrasound wave is issued to the transmission/reception element 4 until when the transmission/reception element 4 detects the ultrasound wave which reflects on the surface of the ink liquid 13 and comes back.

Figure 3:
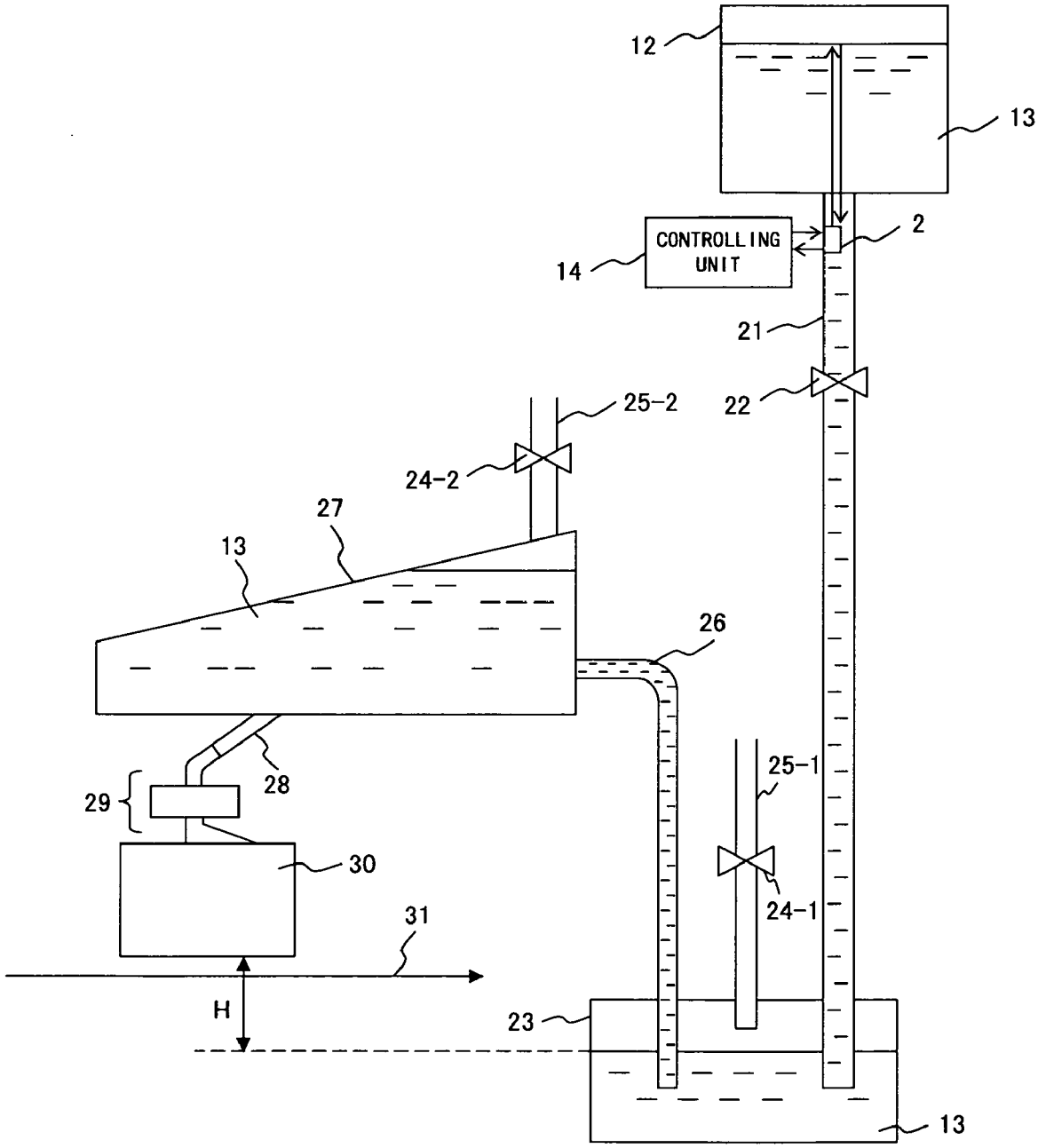
FIG. 3 shows the route of an ink liquid in the image recording apparatus.

FIG. 3 is described next. This figure shows a route of the ink liquid 13 in the image recording apparatus 11. In FIG. 3, the downward direction is the vertically downward direction.

Beneath the bottom of the ink tank 12, one end of an ink supply tube 21 is connected. The other end of the ink supply tube 21 is soaked in the ink liquid 13 within a reservoir tank 23.

On the inner side of the ink supply tube 21 immediately below the ink tank 12, the ink liquid surface detecting sensor 2 is placed, and soaked in the ink liquid 13. As described above, the ink liquid surface detecting sensor 2 transmits the ultrasound wave to the ink liquid 13 contained in the ink tank 12 and receives the ultrasound wave which reflects on the surface of the ink liquid 13 and comes back, under the control performed by the controlling unit 14.

In addition, an opening/closing valve 22 is provided en route from the ink liquid surface detecting sensor 2 to the reservoir tank 23 in the ink supply tube 21.

On the top of the reservoir tank 23 the structure of which is sealed, an air release tube 25-1 having an air release valve 24-1 is provided. Besides, an ink liquid supply tube 26 one end of which is connected to a distributor 27 is soaked in the ink liquid 13 within the reservoir tank 23.

On the top of the distributor 27 the structure of which is sealed, an air open valve 25-2 having an air open valve 24-2 is provided. Additionally, an ink liquid input duct 28 is provided beneath the bottom of the distributor 27. The ink liquid input duct 28 is connected to an ink head 30 via an ink duct sealing mechanism 29. The ink head 30 sprays the ink liquid 13 onto an image recording medium 31 carried under the ink head 30. The height of the bottom of the ink head 30 is positioned higher than the height of the surface of the ink liquid 13 within the reservoir tank 23 by a height H.

In FIG. 3, when an image is recorded, the air release valve 24-1 is opened, and the air release valve 24-2 is closed. As a result, a predetermined negative pressure is applied to the ink head 30, and the image can be recoded onto the image recording medium 31 without making the ink liquid 13 drip. To continually keep the ink liquid within the reservoir tank 23 constant, an ink liquid surface sensor not shown is provided. If the ink liquid surface sensor detects that the ink liquid surface within the reservoir tank 23 goes down, the opening/closing valve 22 is opened, and the ink liquid 13 is provided from the ink tank 12.

Figure 4:
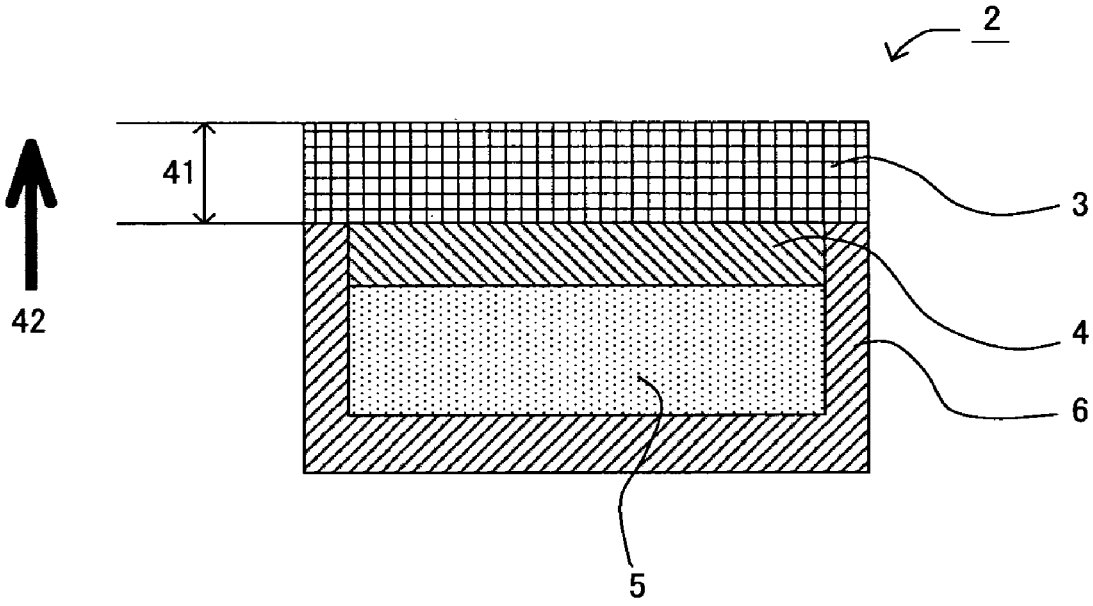
FIG. 4 schematically shows the structure of an ink liquid surface detecting sensor.

FIG. 4 is described next. This figure schematically shows the structure of the ink liquid surface detecting sensor 2.

As described above, the ink liquid surface detecting sensor 2 is configured by comprising the propagating member 3, the transmission/reception element 4, and the sound absorbing member 5, which are supported by the support member 6.

When a pulse signal generated by the controlling unit 14 is input to a communication line not shown, the transmission/reception element 4 generates the ultrasound wave. This ultrasound wave propagates through the propagating member 3, and is transmitted to the link liquid 13. The transmitted ultrasound wave propagates through the ink liquid 13 in a transmission wave propagation direction 42 indicated by an arrow in FIG. 4 (a direction from the transmission/reception element 4 to the ink liquid 13), and is reflected on the surface of the ink liquid 13. The reflected ultrasound wave propagates to the transmission/reception element 4 through the ink liquid 13 and the propagating member 3. When the transmission/reception element 4 receives the ultrasound wave, an electric signal, which corresponds to the reception level of the ultrasound wave, is output from a communication line not shown and transmitted to the controlling unit 14.

Here, a thickness 41 of the propagating member 3 in the transmission wave propagation direction 42 is formed so that the following expression (1) is satisfied.

$$x \leq \frac{D^2 \times f}{4 \times \sqrt{\frac{k}{\rho}}} \tag{1}$$

The right side of the expression (1) is known as an expression that indicates a near sound field limit distance, namely, the position of a limit point in a near sound field. In the expression (1), x, D, and f respectively indicate the thickness 41 of the propagating member 3 in FIG. 4, the diameter of the transmission/reception element 4, which is a circular vibrator, and the frequency of the ultrasound wave transmitted from the transmission/reception element 4. Additionally, k and ρ respectively indicate the elastic constant of the propagating member 3, and the density of the propagating member 3. Therefore, assuming that a sound velocity (a propagation speed of sound) within the propagating member 3 is c, it is known that the following expression (2) holds.

$$c = \sqrt{\frac{k}{\rho}} \tag{2}$$

If the propagating member 3 is formed according to the above provided expression (1) so that the thickness 41 becomes the near sound field limit distance or more, the above described near sound field for the ultrasound wave emitted from the transmission/reception element 4 is formed within the propagating member 3. Namely, as the sound field for the ultrasound wave transmitted from the ink liquid surface detecting sensor 2, only a far sound field is formed within the ink liquid 13. The behavior of the ultrasound wave in the far sound field is stable. Therefore, also the waveform of the ultrasound wave that reflects on the surface of the ink liquid 13 and comes back becomes stable. Accordingly, since also the detection result of the reflection wave by the ink liquid surface detecting sensor 2 becomes definite, the accuracy of the detection result of the height of the liquid surface obtained based on the detection result of the reflection wave is improved.

Additionally, a material in which the propagation speed of sound is faster than the ink liquid 13 is interposed between the transmission/reception element 4 and the ink liquid 13 as the propagating member 3, whereby a distance in which the near sound field is formed can be reduced in comparison with a case where the transmission/reception element 4 and the ink liquid 13 are made to directly contact. This is evident from the above provided expressions (1) and (2).

In this preferred embodiment, the propagating member 3 is configured by using, as a propagating member, aluminum in which the propagation speed of the ultrasound wave is faster than the ink liquid 13 and which is lightweight and easy to be processed. However, other materials may be used. Here, the densities, the sound velocities and the near sound field distances of glycerine, water and oil, which are normal as solvents of the ink liquid 13, and aluminum used as the propagating member 3 in this preferred embodiment are listed below as a table.

| material | density (g/m) | sound velocity (m/s) | near sound field distance (mm) |
|---|---|---|---|
| glycerine | 1.26 | 1920 | 16.27604167 |
| water | 1.00 | 1480 | 21.11486486 |
| oil | 0.92 | 1390 | 22.48201439 |
| aluminum | 2.70 | 6260 | 4.99201278 |

The above table lists the values when the diameter of the transmission/reception element 4 is 5 mm and the frequency of the ultrasound wave is 5000 kHz (5 MHz). Accordingly, it is proved from the above table to form the thickness 41 to be approximately 5 mm or more if aluminum is used as the propagating member 3.

Figure 5:
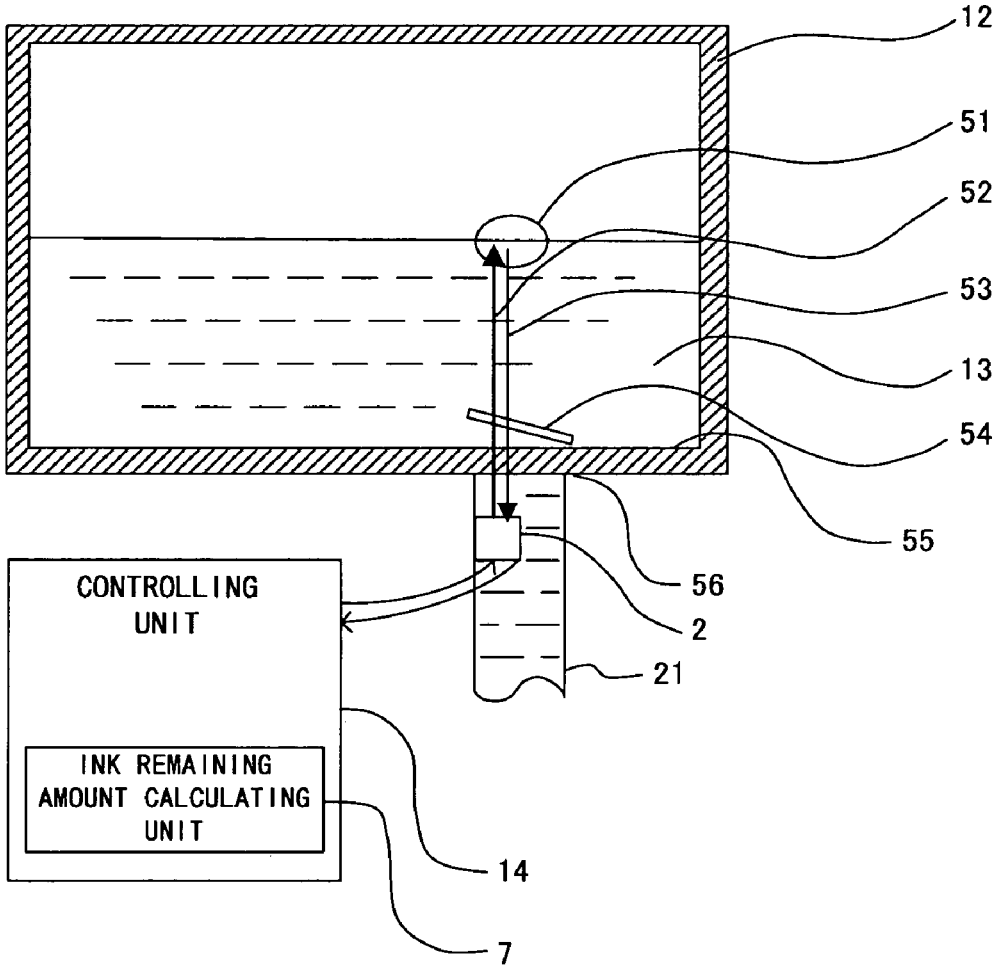
FIG. 5 shows the details of a configuration of a portion peripheral to an ink tank in the first preferred embodiment.

FIG. 5 is described next. This figure shows the details of the configuration of a portion peripheral to the ink tank 12 in this preferred embodiment. The state of the detection of the remaining amount of the ink liquid 13 in this preferred embodiment is described with reference to FIG. 5.

In this figure, the ink tank 12 and the ink supply tube 21 are attached at an ink tank attaching part 56. Additionally, an ink valve 54 is configured to be made open if the ink tank 12 is attached to the ink supply tube 21, and made closed if the ink tank 12 is detached from the ink supply tube 21.

Firstly, the controlling unit 14 generates a pulse signal of a predetermined level, and transmits the generated pulse signal to the transmission/reception element 4. The transmission/reception element 4 generates the ultrasound wave based on the pulse signal, and transmits the ultrasound wave to an ink liquid surface 51 as a transmission wave 52. The transmission wave 52 is reflected on the ink liquid surface 51 and becomes a reflection wave 53.

The transmission/reception element 4 receives the reflection wave 53, and transmits the electric signal, which corresponds to the reception level of the reflection wave 53, to the controlling unit 14. The controlling unit 14 converts the electric signal into digital data corresponding to the signal level, and passes the digital data to the ink remaining amount calculating unit 7.

The ink remaining amount calculating unit 7 measures a time required from when the above described instruction to generate the pulse signal is issued until when the digital data, which corresponds to the reflection wave 53, is received. Then, the ink remaining amount calculating unit 7 calculates a distance from the transmission/reception element 4 to the ink liquid surface 51 from the both-way time which is a result of the measurement and required between the transmission/reception element 4 and the ink liquid surface 51, and the propagation speed of the ultrasound wave within the ink liquid 13, which is prestored in the controlling unit 14. A value, which is obtained by subtracting a distance from the transmission/reception element 4 to a no ink remaining amount reference position 55 (namely, the inner bottom surface of the ink tank 12) from the distance obtained as described above, represents the remaining amount of the ink liquid 13 within the ink tank 12.

Figure 6:
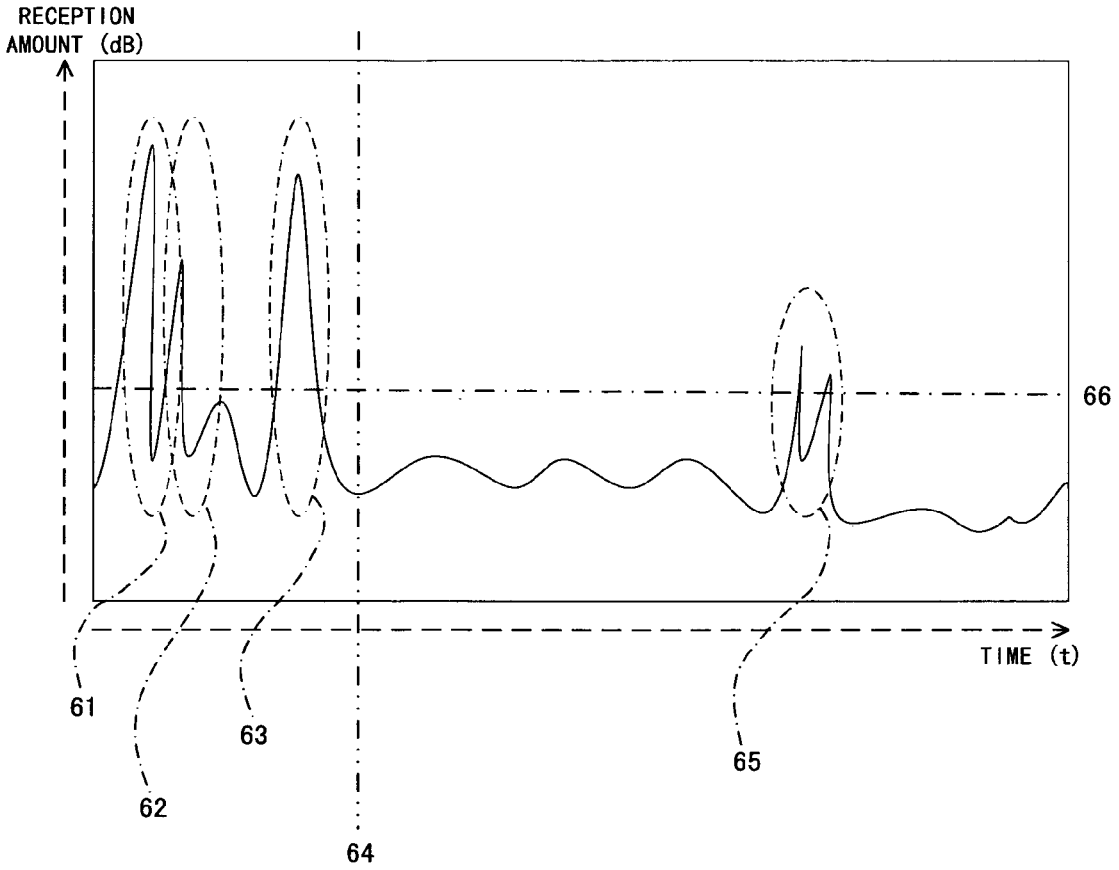
FIG. 6 exemplifies the waveforms of an electric signal output from a transmission/reception element in the first preferred embodiment.

Here, FIG. 6 is described. This figure exemplifies the waveforms of the electric signal output from the transmission/reception element 4 in this preferred embodiment. In FIG. 6, the horizontal axis represents an elapsed time, whereas the vertical axis represents the level of an electric signal, namely, the reception level (reception amount) of the ultrasound wave.

This waveform is described with the passage of time. A waveform 61 is obtained in a way such that the ultrasound wave transmitted by the transmission/reception element 4 itself is directly received. A waveform 62 is obtained in a way such that the ultrasound wave transmitted by the transmission/reception element 4 is received by the transmission/reception element 4 after being reflected by the propagating member 3. A waveform 63 is obtained in a way such that the ultrasound wave transmitted by the transmission/reception element 4 is reflected by the ink valve 54 after being emitted into the ink liquid 13 via the propagating member 3 and received by the transmission/reception element 4. A waveform 65 is obtained in a way such that the ultrasound wave transmitted by the transmission/reception element 4 is reflected on the ink liquid surface 51 after being emitted into the ink liquid 13 and received by the transmission/reception element 4.

In the description provided below, the waveforms 61, 62, 63 and 65 are referred to as a transmission waveform, a propagating member reflection waveform, an ink valve reflection waveform, and a liquid surface reflection waveform, respectively.

To detect the remaining amount of the ink liquid 13, the transmission wave form 61, the propagating member reflection waveform 62 and the ink valve reflection waveform 63 are unnecessary among the above described waveforms, and only the liquid surface reflection waveform 65 is necessary. Here, the physical position relationship among the transmission/reception element 4, the propagating member 3 and the ink valve 54 does not vary. Accordingly, the elapsed time from when the transmission/reception element 4 transmits the ultrasound wave until when the transmission/reception element 4 receives these waveforms is constant, and it is evident that all of the unnecessary waveforms are received prior to the liquid surface reflection waveform 65.

Therefore, the ink remaining amount calculating unit 7, a detection start time 64 is preset, and the waveforms of the ultrasound wave from when the transmission/reception element 4 transmits the ultrasound wave until when the detection start time 64 is passed are ignored.

Here, it is better to set the detection start time 64 to a time that is longer than an elapsed time during which all of the transmission waveform 61, the propagating member reflection waveform 62 and the ink valve reflection waveform 63 can be obtained, and shorter than an elapsed time during which the liquid surface reflection waveform 65 can be obtained at earliest. Here, the elapsed time during which the liquid surface reflection waveform 65 can be obtained at earliest is equivalent to an elapsed time during which the liquid surface reflection waveform 65 can be obtained when the ink liquid surface 51 stays in the no ink remaining amount reference position 55. The detection start time 64 is set in this way, whereby the transmission waveform 61, the propagating member reflection waveform 62 and the ink valve reflection waveform 63 can be excluded from the signal waveforms obtained from the transmission/reception element 4. As a result, the ink remaining amount calculating unit 7 can properly detect the remaining amount of the ink liquid 13 based on the liquid surface reflection waveform 65.

Additionally, in the ink remaining amount calculating unit 7, a liquid surface reflection reference value 66 is set in addition to the detection start time 64, and also the waveform of the ultrasound wave having a reception level in the transmission/reception element 4, which does not reach the liquid surface reflection reference value 66, is ignored.

Here, it is better to set the liquid surface reflection reference value 66 to a value that is smaller than the maximum value of the liquid surface reflection waveform 65 obtained when the ink tank 12 is filled with the ink liquid 13 of the maximum amount allowed. The liquid surface reflection reference value 66 is set in this way, whereby the ink remaining amount calculating unit 7 can properly extract the liquid surface reflection waveform 65 by excluding the waveforms, which correspond to noise components, from the signal waveforms obtained from the transmission/reception element 4. As a result, the ink remaining amount calculating unit 7 can detect the remaining amount of the ink liquid 13 based on the liquid surface reflection waveform 65 with high accuracy.

Figure 7:
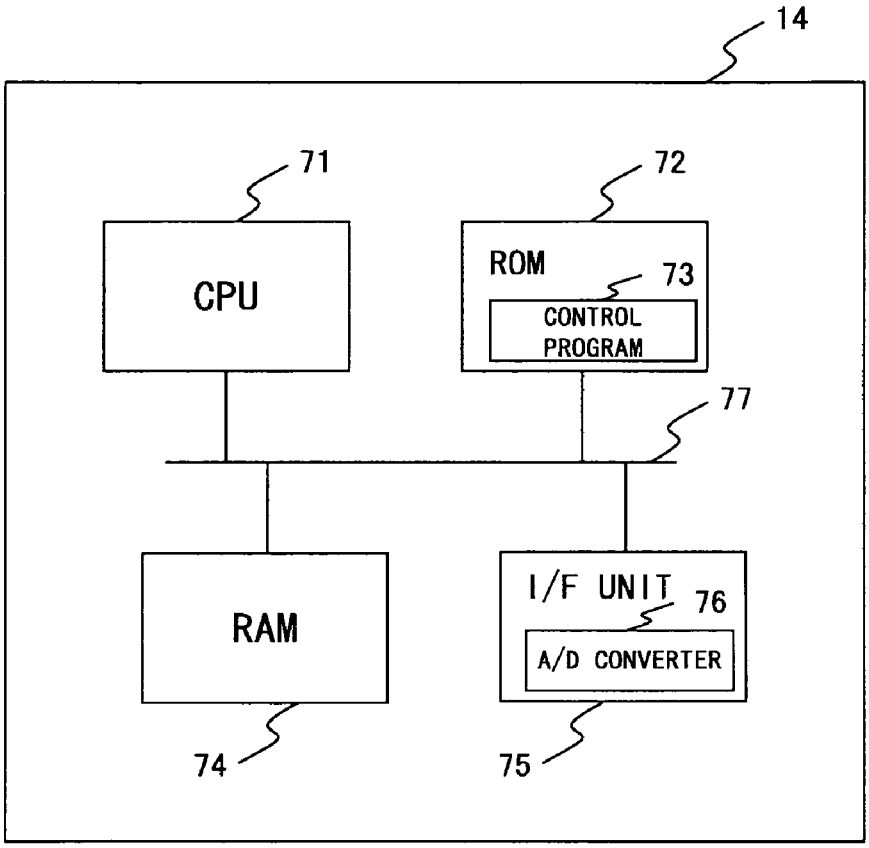
FIG. 7 shows a hardware configuration of a controlling unit.

FIG. 7 is described next. This figure shows a hardware configuration of the controlling unit 14.

In FIG. 7, a CPU 71, a ROM 72, a RAM 74 and an I/F unit 75 are interconnected via a bus 77, and can mutually transmit/receive various types of data under the control of the CPU 71.

The CPU (Central Processing Unit) 71 is an arithmetic processing unit for controlling the operations of the entire image recording apparatus 11.

The ROM 72 is a program recording medium on which a control program 73 executed by the CPU 71 is prestored, and from which the control program 73 can be read by the CPU 71. The CPU 71 executes the control program 73, whereby the CPU 71 can function as the ink remaining amount calculating unit 7, and can control the operations of the entire image recording apparatus 11.

The RAM 74 is a memory that the CPU 71 uses as a working area on demand when executing the control program 73.

The I/F (interface) unit 75 manages the transmission/reception of various types of data between the respective constituent elements of the image recording apparatus 11 and the controlling unit 14. Additionally, the I/F unit 75 comprises an analog-to-digital converter 76, converts the electric signal (analog signal), which is transmitted from the transmission/reception element 4 and corresponds to the reception level of the ultrasound wave, into digital data, and transmits the digital data to the CPU 71. If the CPU 71 itself comprises an analog-to-digital conversion function, the electric signal may be converted into digital data with this function.

Figure 8:
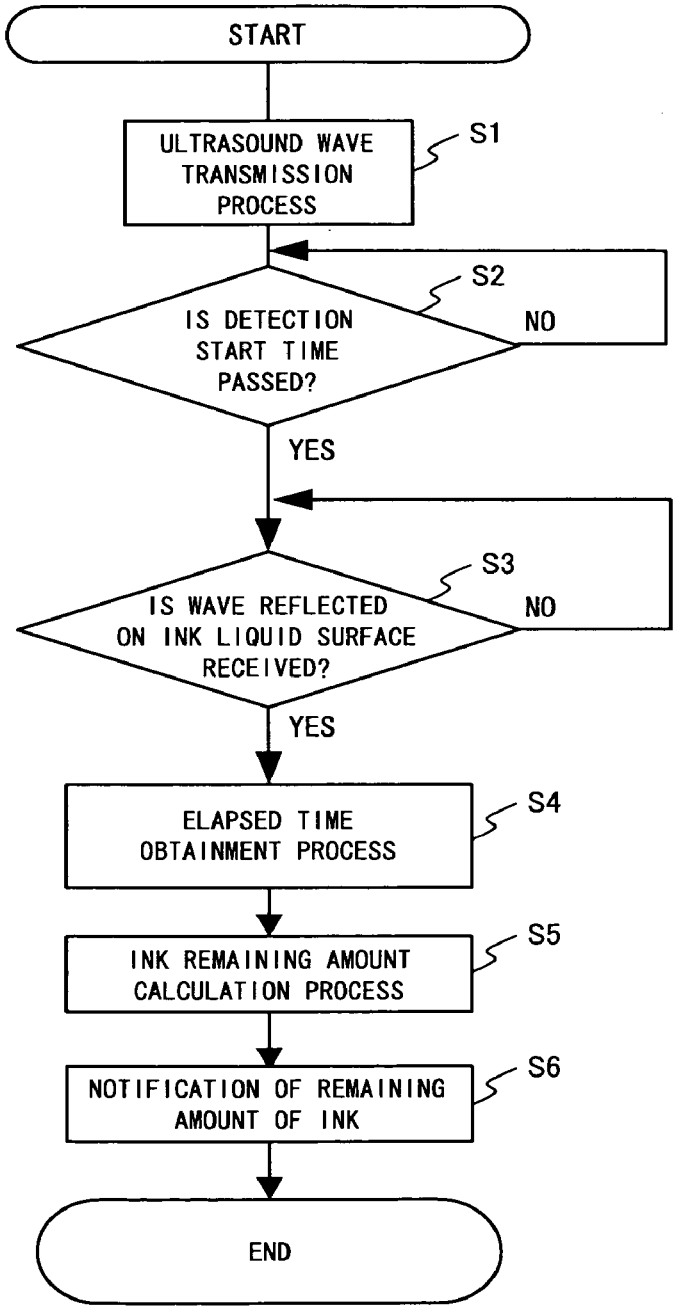
FIG. 8 is a flowchart showing the contents of an ink remaining amount detection process.

FIG. 8 is described next. This figure is a flowchart showing the contents of an ink remaining amount detection process. The CPU 71 reads the control program 73 from the ROM 72 and executes the control program 73, whereby the controlling unit 14 implements this process.

In FIG. 8, firstly, in S1, the controlling unit 14 executes an ultrasound wave transmission process, namely, a process for generating the pulse signal, for applying the pulse signal to the transmission/reception element 4, and for causing the transmission/reception element 4 to transmit the ultrasound wave to the ink liquid 13. As described above, the ink liquid surface detecting sensor 2 comprising the transmission/reception element 4 has the structure shown in FIG. 4. Therefore, if the transmission/reception element 4 is made to transmit the ultrasound wave, the near sound field of the ultrasound wave is formed within the propagating member 3.

Then, in S2, the controlling unit 14 executes a process for measuring an elapsed time from when the process of S1 is executed, and for determining whether or not the elapsed time passes the detection start time 64 shown in FIG. 6. Here, if the controlling unit 14 determines that the elapsed time passes the detection start time 64 (a result of the determination is "Yes"), the controlling unit 14 advances the process to S3. Or, if the controlling unit 14 determines that the elapsed time has not passed the detection start time 64 yet (the result of the determination is "No"), the controlling unit 14 repeats the process of S2 until the elapsed time passes the detection start time 64.

With the process of S2, the waveforms of the ultrasound wave received by the transmission/reception element 4 until the elapsed time passes the detection start time 64 are ignored, and the remaining amount of the ink liquid 13 is calculated based on the elapsed time if the elapsed time is equal to or more than the detection start time 64.

Then, in S3, the controlling unit 14 executes a process for causing the transmission/reception element 4 to receive the ultrasound wave, which is transmitted from the transmission/reception element 4 and reflected on the ink liquid surface 51, and for determining whether or not the reflection wave is received. This process is specifically a process, which is executed by the controlling unit 14, for monitoring the waveform of the electric signal transmitted from the transmission/reception element 4 to the controlling unit 14, and for determining whether or not the liquid surface reflection waveform 65 shown in FIG. 6 is detected by making a largeness/smallness comparison with the liquid surface reflection reference value 66.

In the process of S3, if the controlling unit 14 determines that the reflection wave 53 from the ink liquid surface 51 is received based on the fact that the transmission/reception element 4 receives the ultrasound wave at an intensity equal to or higher than the liquid surface reflection reference value 66 (a result of the determination is "Yes"), this unit advances the process to S4. Or, if the controlling unit 14 determines that the reflection wave 53 from the ink liquid surface 51 has not received yet (the result of the determination is "No"), this unit repeats the determination process of S3 until the reflection wave 53 is received.

Then, in S4, the controlling unit 14 executes an elapsed time obtainment process, namely, a process for obtaining the measurement result of the elapsed time from when the process of S1 is executed.

Next, in S5, the controlling unit 14 executes an ink remaining amount calculation process. In this process, the controlling unit 14 calculates a both-way distance between the transmission/reception element 4 and the ink liquid surface 51 by multiplying the elapsed time obtained with the process of S4 by the sound velocity (see the above provided table) within the ink liquid 13. Then, the controlling unit 14 calculates the distance from the transmission/reception element 4 to the ink liquid surface 51 by halving the calculated both-way distance. Next, the controlling unit 14 obtains the remaining amount of the ink liquid 13 within the ink tank 12 based on the value of the distance, and the shape of the inside of the ink tank 12, which is known. At this time, the calculation accuracy of the remaining amount of the ink liquid 13 may be improved in a way such that the controlling unit 14 performs an arithmetic operation for excluding influences exerted by the distance between the no ink remaining amount reference position 55 and the ink liquid surface detecting sensor 2, and the thickness 41 of the propagating member 3.

The controlling unit 14, which executes the processes in the above described S2 to S5, provides the function as the ink remaining amount detecting unit 7. Namely, the controlling unit 14 provides the function for calculating the remaining amount of the ink liquid 13 within the ink tank 12 based on the elapsed time required from when the transmission/reception element 4 transmits the ultrasound wave until when the transmission/reception element 4 receives the ultrasound wave reflected on the ink liquid surface 51.

Next, in S6, the controlling unit 14 executes a process for notifying a higher-order apparatus (not shown), which uses the image recording apparatus 11, of the remaining amount of the ink liquid 13 obtained with the process of S5, and then terminates the ink remaining amount detection process.

As described above, in this preferred embodiment, the propagating member 3 is provided between the transmission/reception element 4, which transmits/receives the ultrasound wave, and the ink liquid 13, and the near sound field of the ultrasound wave is formed within the propagating member 3. According to this preferred embodiment, with such a simple configuration, the reflection wave on the surface of the ink liquid 13 can be detected with high accuracy without executing a process for excluding unnecessary reflection waves, which are generated by the near sound field positioned on the surface of the ink liquid 13, and without altering the quality of the ink liquid 13. Additionally, the remaining amount of the ink liquid 13 can be obtained with high accuracy, whereby the ink liquid 13 within the ink tank 12 can be used up, leading to a high degree of cost effectiveness.

Second Preferred Embodiment

This preferred embodiment is intended to detect the type of an ink liquid in addition to the detection of the remaining amount of the ink liquid contained in an ink tank.

In the description of this preferred embodiment, constituent elements common to those in the above described first preferred embodiment are denoted with the same reference numerals, and their explanations are omitted. Additionally, in this preferred embodiment, explanations about operations and effects common to those in the above described first preferred embodiment are omitted. Accordingly, the detection of the type of the ink liquid is described in detail in this preferred embodiment.

Figure 9:
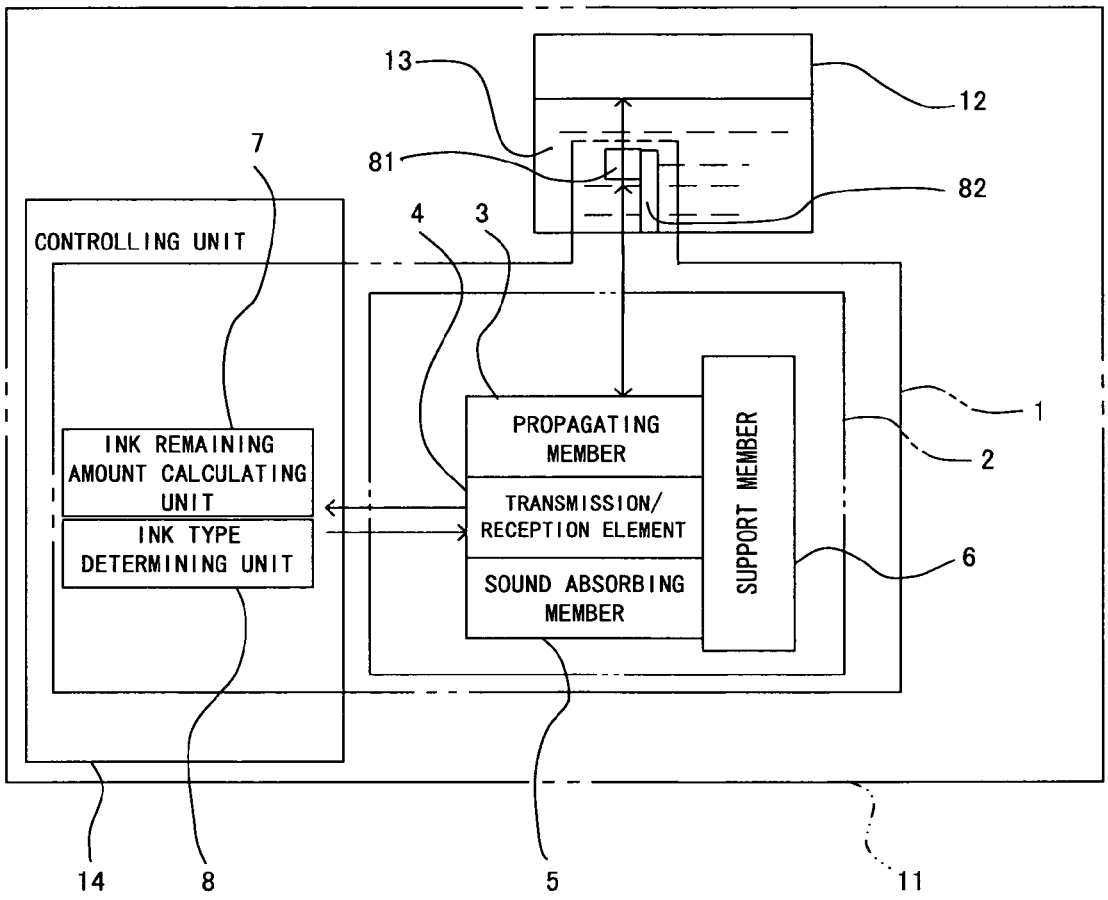
FIG. 9 is a conceptual block diagram showing an image recording apparatus comprising an ink detecting device according to a second preferred embodiment.

FIG. 9 is described first. This figure is a conceptual block diagram showing an image recording apparatus 11 comprising an ink detecting device 1 according to this preferred embodiment.

The image recording apparatus 11 shown in FIG. 9 is different from that shown in FIG. 2 in a point that the image recording apparatus 11 further comprises an ink type determining unit 8, a reflection mechanism 81 and a reflection mechanism support member 82. The ink type determining unit 8 may be implemented in a way such that a CPU comprised by the controlling unit 14 is made to execute a program stored in the controlling unit 14. Additionally, this program may be stored in an arithmetic processing unit other than the controlling unit 14.

The ink type determining unit 8 detects the type of an ink liquid 13 based on a time required from when an instruction to transmit the ultrasound wave is issued to a transmission/reception element 4 until when the transmission/reception element 4 detects the ultrasound wave that reflects on the liquid surface of the reflection mechanism 81 and comes back.

A route of the ink liquid 13 in the image recording apparatus 11 according to this preferred embodiment is similar to that according to the first preferred embodiment, which is shown in FIG. 3. Also the structure of a ink liquid surface detecting sensor 2 is similar to that according to the first preferred embodiment, which is shown in FIG. 4. Furthermore, aluminum is used as a propagating member 3 also in this preferred embodiment.

Figure 10:
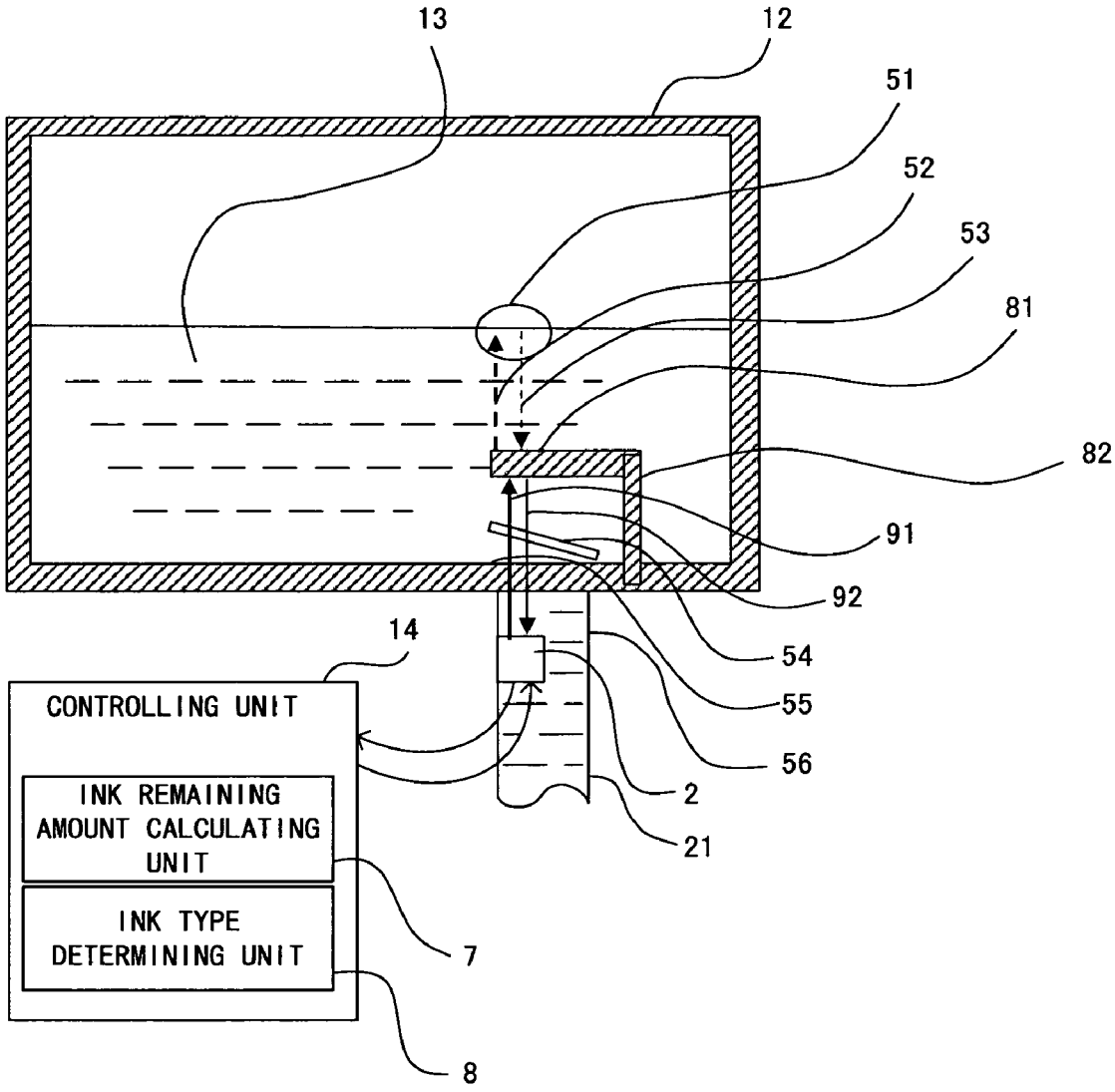
FIG. 10 shows the details of a configuration of a portion peripheral to an ink tank in the second preferred embodiment.

FIG. 10 is described next. This figure shows the details of the configuration of a portion peripheral to the ink tank 12 in this preferred embodiment. The state of the determination of the type of the ink liquid 13 in this preferred embodiment is described with reference to this figure.

As described above, in this preferred embodiment, differences from the first preferred embodiment exist in the points that the controlling unit 14 also functions as the ink type determining unit 8, the ink detecting device 1 further comprises the reflection mechanism 81 for reflecting the ultrasound wave, and the reflection mechanism support member 82 for supporting the reflection mechanism 81, and the reflection mechanism 81 and the reflection mechanism support member 82 are provided within the ink tank 12. Accordingly, also FIG. 10 is different from FIG. 5 in these points.

Firstly, the controlling unit 14 generates a pulse signal of a predetermined level, and transmits the generated pulse signal to the transmission/reception element 4. The transmission/reception element 4 generates the ultrasound wave based on the pulse signal, and transmits the ultrasound wave as transmission waves 52 and 91 to an ink liquid surface 51. The transmission wave 52 among the waves reflects on the ink liquid surface 51 and becomes a reflection wave 53 in a similar manner as in the first preferred embodiment. In the meantime, the transmission wave 91 reflects on the reflection mechanism 81 held in a state of being soaked in the ink liquid 13 within the ink tank 12, and becomes a reflection wave 92.

The transmission/reception element 4 receives the reflection waves 53 and 92, and transmits an electric signal, which corresponds to each of their reception levels, to the controlling unit 14. The controlling unit 14 converts the electric signal into digital data corresponding to the level of the electric signal, and passes the digital data to an ink remaining amount calculating unit 7 and the ink type determining unit 8.

The ink remaining amount calculating unit 7 measures a time required from when the above described instruction to generate the pulse signal is issued until when the digital data corresponding to the reflection wave 53 is received, and obtains the remaining amount of the ink liquid 13 within the ink tank 12 based on a result of the measurement in a similar manner as in the first preferred embodiment.

In the meantime, the ink type determining unit 8 measures a time required from when the above described instruction to generate the pulse signal is issued until when the digital data corresponding to the reflection wave 92 is received. Then, the ink type determining unit 8 calculates a propagation speed (sound velocity) of the ultrasound wave within the ink liquid 13 based on a time that the ultrasound wave requires in a both-way distance between the transmission/reception element 4 and the reflection mechanism 81, which is a result of the measurement, and the both-way distance between the transmission/reception element 4 and the reflection mechanism 81, which is known. Then, the ink type determining unit 8 identifies the type of the ink liquid 13 based on the sound velocity thus calculated. Here, the ink type is identified by preparing a table, which represents the type and the sound velocity of the ink liquid 13 as exemplified by the above provided table, in advance, and by obtaining the ink type, which corresponds to the sound velocity calculated as described above, with reference to the table.

Note that the reflection mechanism 81 and the reflection mechanism support member 82 may be members of the same material. This enables the reflection mechanism 81 and the reflection mechanism support member 82 to be easily formed by being molded in one piece.

Incidentally, separate ultrasound waves may be transmitted from the transmission/reception element 4 as those for detecting the remaining amount and the type of ink respectively. However, the reception levels, in the transmission/reception element 4, of the ultrasound wave which reflects on the ink liquid surface 51 and comes back to the transmission/reception element 4, and the ultrasound wave which reflects on the reflection mechanism 81 and comes back to the transmission/reception element 4 are definitely different. Therefore, the ultrasound wave transmitted from the transmission/reception element 4 can be shared by using this difference.

Figure 11:
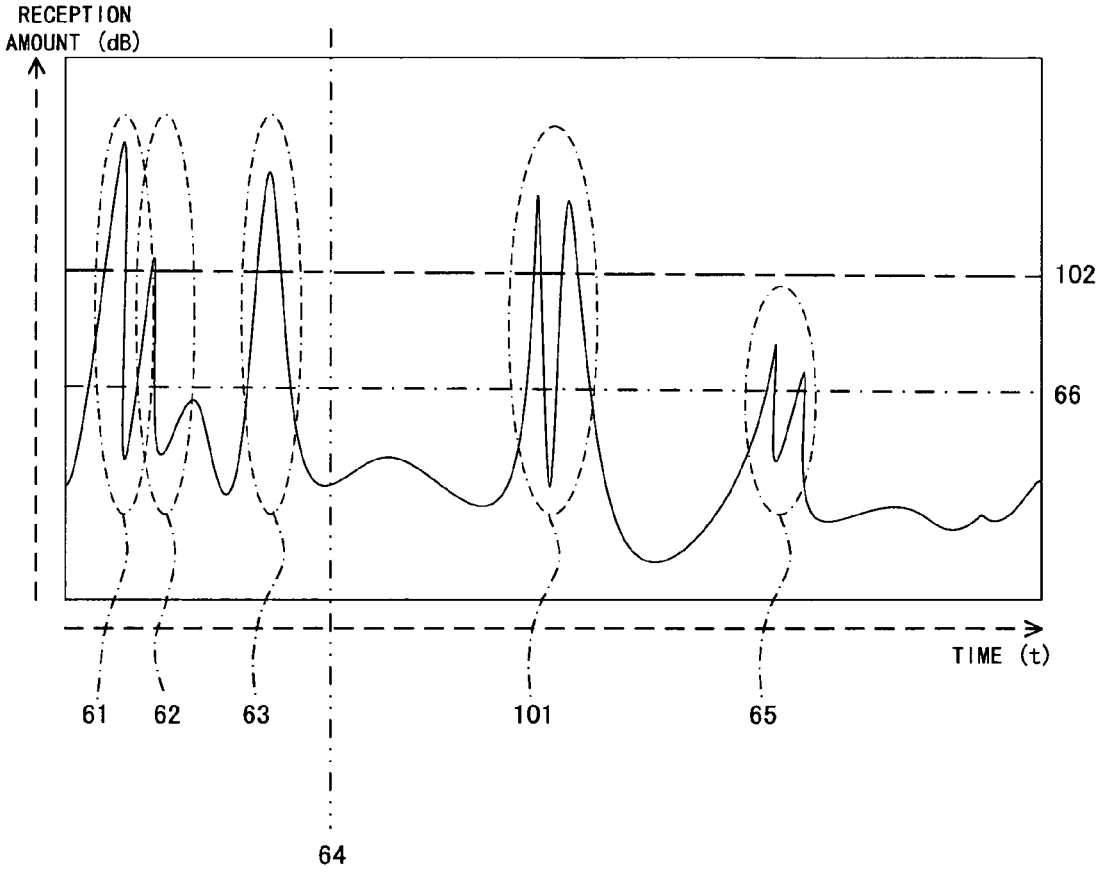
FIG. 11 exemplifies the waveforms of an electric signal output from a transmission/reception element in the second preferred embodiment.

Here, FIG. 11 is described. This figure exemplifies the waveforms of the electric signal output from the transmission/reception element 4 in this preferred embodiment. In FIG. 11, the horizontal axis represents an elapsed time, whereas the vertical axis represents the level of an electric signal, namely, the reception level (reception amount) of the ultrasound wave.

The waveforms shown in FIG. 11 differ from those according to the first preferred embodiment, which are shown in FIG. 6, in a point that a waveform 101 exists. The waveform 101 is obtained in a way such that the ultrasound wave transmitted from the transmission/reception element 4 is reflected on the reflection mechanism 81 after being emitted into the ink liquid 13 via the propagating member 3, and received by the transmission/reception element 4. This waveform 101 is hereinafter referred to as a "reflection mechanism reflection waveform".

In the ink remaining amount calculating unit 7, a detection start time 64 and a liquid surface reflection reference value 66 are set in a similar manner as in the first preferred embodiment. This enables the liquid surface reflection waveform 65 to be properly extracted from signal waveforms obtained from the transmission/reception element 4, and the detection of the remaining amount of the ink liquid 13 based on the liquid surface reflection waveform 65 can be made with high accuracy.

In the meantime, in the ink type determining unit 8, a reflection mechanism reflection wave reference value 102 is set in addition to the detection start time 64. Then, the ink type determining unit 8 ignores the waveforms of the ultrasound wave received from when the transmission/reception element 4 transmits the ultrasound wave until when the transmission/reception element 4 receives the ultrasound wave up to the passage of the detection start time 64, and also ignores the waveform of the ultrasound wave the reception level of which does not reach the reflection mechanism reflection wave reference value 102.

Here, it is better to set the reflection mechanism reflection wave reference value 102 to a value larger than the liquid surface reflection reference value 66. This is because the reflection mechanism 81 having a propagation speed that is different from the ink liquid is interposed by the time the transmission/reception element 4 receives the liquid surface reflection waveform 65, unlike the case where the transmission/reception element 4 receives the reflection mechanism reflection waveform 101. The reflection mechanism reflection wave reference value 102 is set in this way, whereby the ink type determining unit 8 can properly extract only the reflection mechanism reflection waveform 101 by excluding unnecessary waveforms from the signal waveforms obtained from the transmission/reception element 4. Accordingly, the ink type determining unit 8 can detect the type of the ink liquid 13 based on the reflection mechanism reflection waveform 101.

Note that the ink remaining amount calculating unit 7 may determine a signal waveform which is received after the detection start time 64, and the maximum value of which is larger than the liquid surface reflection reference value 66 and smaller than the reflection mechanism reflection wave reference value 102 among the signal waveforms obtained from the transmission/reception element 4, as the liquid surface reflection waveform 65. Or, if the ink type determining unit 8 detects the reflection mechanism reflection waveform 101, this unit may determine a signal waveform, which exceeds the liquid surface reflection reference value 66, as the liquid surface reflection waveform 65 after the detection of the reflection mechanism reflection waveform 101.

Details of the controlling unit 14 are described next.

A hardware configuration of the controlling unit 14 in this preferred embodiment is similar to that in the first preferred embodiment, which is shown in FIG. 7. However, a CPU 71 executes an ink type detection process the contents of which are represented by a flowchart shown in FIG. 12 in addition to an ink remaining amount detection process similar to that shown in FIG. 8, when reading a control program 73 prestored in a ROM 72.

Figure 12:
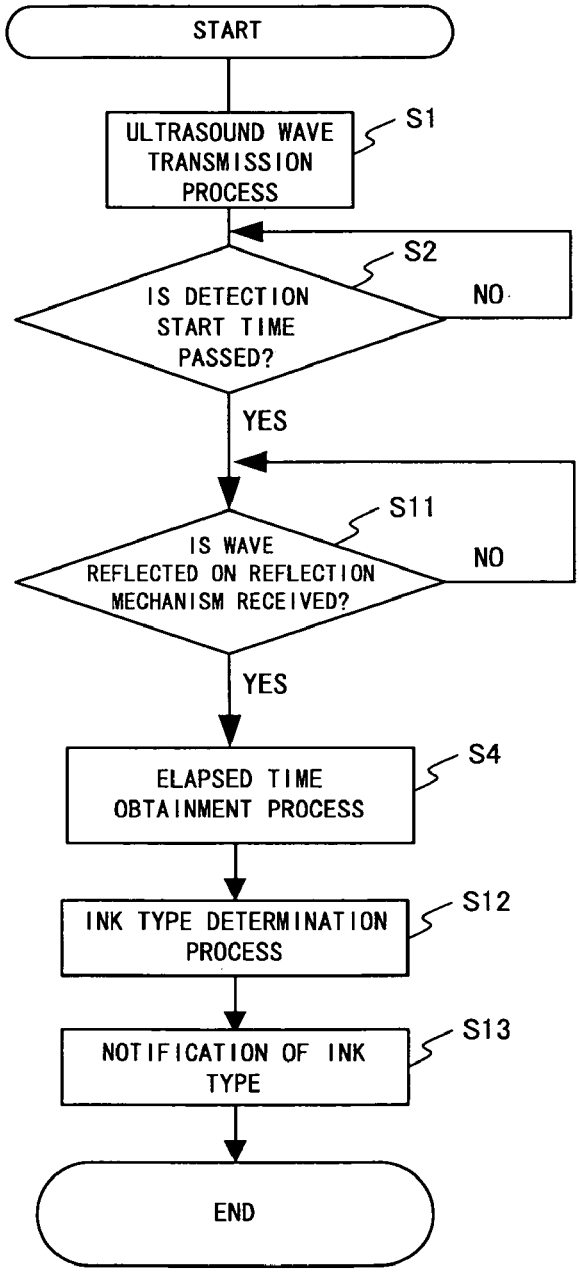
FIG. 12 is a flowchart showing the contents of an ink type detection process.

The contents of the ink type detection process are described with reference to FIG. 12.

In this figure, firstly, in S1, the controlling unit 14 executes the ultrasound wave transmission process, namely, a process for generating the pulse signal, for applying the pulse signal to the transmission/reception element 4, and for causing the transmission/reception element 4 to transmit the ultrasound wave to the ink liquid 13. Since the ink liquid surface detecting sensor 2 comprising the transmission/reception element 4 has the structure shown in FIG. 4, a near sound field of the ultrasound wave is formed within the propagating member 3 if the transmission/reception element 4 is made to transmit the ultrasound wave.

Then, in S2, the controlling unit 14 executes a process for measuring an elapsed time from when the process of S1 is executed, and for determining whether or not the elapsed time passes the detection start time 64 shown in FIG. 11. Here, if the controlling unit 14 determines that the elapsed time passes the detection start time 64 (a result of the determination is "Yes"), this unit advances the process to S11. Or, if the controlling unit 14 determines that the elapsed time has not passed the detection start time 64 yet (the result of the determination is "No"), this unit repeats the process of S2 until the detection start time 64 is passed.

With the process of S2, the waveforms of the ultrasound wave, which are received by the transmission/reception element 4 until the detection start time 64 is passed, are ignored, and the type of the ink liquid 13 is determined based on the elapsed time if the elapsed time is equal to or more than the detection start time 64.

Then, in S11, the controlling unit 14 executes a process for causing the transmission/reception element 4 to receive the ultrasound wave which is transmitted from the transmission reception element 4 and reflected from the reflection mechanism 81, and for determining whether or not the reflection wave is received. This process is specifically a process for monitoring the waveform of the electric signal transmitted from the transmission/reception element 4 to the controlling unit 14, and for determining whether or not the reflection mechanism reflection waveform 101 shown in FIG. 11 is detected by making a largeness/smallness comparison with the reflection mechanism reflection wave reference value 102.

In S11, if the controlling unit 14 determines that the reflection wave from the reflection mechanism 81 is received based on the fact that the transmission/reception element 4 receives the ultrasound wave at an intensity equal to or higher than the reflection mechanism reflection wave reference value 102 (a result of the determination is "Yes"), this unit advances the process to S4. Or, if the controlling unit 14 determines that the reflection wave from the reflection mechanism 81 has not received yet (the result of the determination is "No"), this unit repeats the determination process of S11 until the reflection wave is received.

Then, in S4, the controlling unit 14 executes an elapsed time obtainment process, namely, a process for obtaining the measurement result of the elapsed time from when the process of S1 is executed.

Next, the controlling unit 14 executes an ink type determination process in S12. With this process, the controlling unit 14 firstly calculates the sound velocity (propagation speed) of the ultrasound wave within the ink liquid 13 by dividing the both-way distance, which is known, between the transmission/reception element 4 and the reflection mechanism 81 by the elapsed time obtained with the process of S4. Then, the controlling unit 14 references a table, which is prestored in the ROM 72, exemplified by the above provided table, and represents a relationship between the type and the sound velocity of the ink liquid 13, and selects the ink type, which corresponds to the sound velocity calculated as described above, from the table. The type of the ink liquid 13 is determined in this way. Here, the accuracy of the determination of the type of the ink liquid 13 may be improved in a way such that the controlling unit 14 performs an arithmetic operation for excluding influences exerted by the distance between the no ink remaining amount reference position 55 and the liquid surface detecting sensor 2, and the thickness 41 of the propagating member 3.

The controlling unit 14, which executes the above described processes of S2, S11, S4 and S12, provides a function as the ink type determining unit 8. Namely, the controlling unit 14 provides the function for determining the type of the ink liquid 13 based on the elapsed time required from when the transmission/reception element 4 transmits the ultrasound wave until when the transmission/reception element 4 receives the ultrasound wave reflected on the reflection mechanism 81.

Then, in S13, the controlling unit 14 executes a process for notifying a higher-order apparatus (not shown), which uses the image recording apparatus 11, of the type of the ink liquid 13 obtained with the process of S12. Thereafter, the controlling unit 14 terminates the ink type determination process.

As described above, in this preferred embodiment, the reflection mechanism 81 is provided within the ink tank 12 in addition to the configuration of the first preferred embodiment, and also the ultrasound wave reflected on the reflection mechanism 81 is received by the transmission/reception element 4. According to this preferred embodiment, by using this configuration, operations and effects similar to those of the first preferred embodiment can be obtained, and at the same time, the sound velocity of the ultrasound wave that propagates through the ink liquid 13 can be obtained, whereby the type of the ink liquid 13 can be detected. Accordingly, for example, ink solvents are made different respectively for the colors of ink liquids 13, whereby the ink liquid 13 can be prevented from being erroneously infused even when the shapes of ink tanks 12 are made identical for the colors of the contained ink liquids. Additionally, the type of the ink liquid 13 can be detected, thereby eliminating the need for conventionally placing a recording element in an ink tank 12 in order to prevent the ink head 30 from being damaged by the ink liquid 13 of poor quality.

As described above, according to both of the two preferred embodiments for implementing the present invention, the ink liquid within the ink tank can be detected with high accuracy without altering the quality of the ink.

In addition, the present invention is not limited to the above described preferred embodiments, and various types of modifications and changes can be made within a scope which does not deviate from the gist of the present invention.

What is claimed is:

1. An ink detecting device configured to detect ink contained in a tank, the ink detecting device comprising:

a transmission/reception element which transmits/receives an ultrasound wave;

a sound absorbing member which absorbs at least the ultrasound wave from the transmission/reception element;

a propagating member which is adapted to propagate the ultrasound wave transmitted from the transmission/reception element to the ink, and in which a near sound field of the ultrasound wave transmitted from the transmission/reception element is formed; and an ink remaining amount calculating unit which is configured to calculate a remaining amount of the ink based on an elapsed time from when the transmission/reception element transmits the ultrasound wave until when the transmission/reception element receives the ultrasound wave reflected on a liquid surface of the ink, wherein the propagating member has a thickness that is at least equal to a near sound field limit distance of the ultrasound wave transmitted from the transmission/reception element.

2. The ink detecting device according to claim 1, wherein the propagating member is made of a material in which a propagation speed of the ultrasound wave is faster than in the ink.

3. The ink detecting device according to claim 2, wherein the propagating member contains aluminum.

4. The ink detecting device according to claim 1, wherein a propagation surface of the propagating member is adapted to contact the ink and propagate the ultrasound wave transmitted from the transmission/reception element toward the liquid surface of the ink.

5. The ink detecting device according to claim 1, wherein the ink remaining amount calculating unit calculates the remaining amount of the ink by calculating a distance between the transmission/reception element and the liquid surface of the ink based on the elapsed time and a propagation speed of the ultrasound wave through the ink.

6. An image recording apparatus configured to detect ink contained in a tank, the image recording apparatus comprising:

a transmission/reception element which transmits/receives an ultrasound wave;

a sound absorbing member which absorbs at least the ultrasound wave from the transmission/reception element;

a propagating member which is adapted to propagate the ultrasound wave transmitted from the transmission/reception element to the ink, and in which a near sound field of the ultrasound wave transmitted from the transmission/reception element is formed;

an ink remaining amount calculating unit which is configured to calculate a remaining amount of the ink based on an elapsed time from when the transmission/reception element transmits the ultrasound wave until when the transmission/reception element receives the ultrasound wave reflected on a liquid surface of the ink; and an ink head which is adapted to record an image on an image recording medium by spraying the ink, wherein the propagating member has a thickness that is at least equal to a near sound field limit distance of the ultrasound wave transmitted from the transmission/reception element.

7. The image recording apparatus according to claim 6, wherein a propagation surface of the propagating member is adapted to contact the ink and propagate the ultrasound wave transmitted from the transmission/reception element toward the liquid surface.

8. An ink detecting device configured to detect ink contained in a tank, the ink detecting device comprising:

a transmission/reception element which transmits/receives an ultrasound wave;

a sound absorbing member which absorbs at least the ultrasound wave from the transmission/reception element;

a propagating member which is adapted to propagate the ultrasound wave transmitted from the transmission/reception element to the ink, and in which a near sound field of the ultrasound wave transmitted from the transmission/reception element is formed; and an ink remaining amount calculating unit which is configured to calculate a remaining amount of the ink based on an elapsed time from when the transmission/reception element transmits the ultrasound wave until when the transmission/reception element receives the ultrasound wave reflected on a liquid surface of the ink, wherein the propagating member is made of a material containing aluminum in which a propagation speed of the ultrasound wave is faster than in the ink.

9. The ink detecting device according to claim 8, wherein a propagation surface of the propagating member is adapted to contact the ink and propagate the ultrasound wave transmitted from the transmission/reception element toward the liquid surface.

10. An image recording apparatus configured to detect ink contained in a tank, the image recording apparatus comprising:

a transmission/reception element which transmits/receives an ultrasound wave;

a sound absorbing member which absorbs at least the ultrasound wave from the transmission/reception element;

a propagating member which is adapted to propagate the ultrasound wave transmitted from the transmission/reception element to the ink, and in which a near sound field of the ultrasound wave transmitted from the transmission/reception element is formed;

an ink remaining amount calculating unit which is configured to calculate a remaining amount of the ink based on an elapsed time from when the transmission/reception element transmits the ultrasound wave until when the transmission/reception element receives the ultrasound wave reflected on a liquid surface of the ink; and an ink head which is adapted to record an image on an image recording medium by spraying the ink, wherein the propagating member is made of a material containing aluminum in which a propagation speed of the ultrasound wave is faster than in the ink.

11. The image recording apparatus according to claim 10, wherein a propagation surface of the propagating member is adapted to contact the ink and propagate the ultrasound wave transmitted from the transmission/reception element toward the liquid surface.

* * * * *